US009447668B2

(12) United States Patent
Gano

(10) Patent No.: US 9,447,668 B2
(45) Date of Patent: Sep. 20, 2016

(54) WELLBORE STEAM INJECTOR

(71) Applicant: Halliburton Energy Services, Inc., Houston, TX (US)

(72) Inventor: John Charles Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 255 days.

(21) Appl. No.: 14/368,395

(22) PCT Filed: Aug. 21, 2013

(86) PCT No.: PCT/US2013/056014
§ 371 (c)(1),
(2) Date: Jun. 24, 2014

(87) PCT Pub. No.: WO2015/026340
PCT Pub. Date: Feb. 26, 2015

(65) Prior Publication Data

US 2015/0218922 A1 Aug. 6, 2015

(51) Int. Cl.
*E21B 43/24* (2006.01)
*E21B 34/14* (2006.01)

(52) U.S. Cl.
CPC ..... *E21B 43/2406* (2013.01); *E21B 34/14* (2013.01)

(58) Field of Classification Search
CPC ..... E21B 43/24; E21B 43/2406; E21B 43/2408; E21B 34/14; E21B 36/00; E21B 2034/007
See application file for complete search history.

(56) References Cited

U.S. PATENT DOCUMENTS

| | | | | |
|---|---|---|---|---|
| 7,631,694 | B2 | 12/2009 | Struyk et al. | |
| 2004/0194972 | A1 | 10/2004 | Braddick | |
| 2008/0169095 | A1* | 7/2008 | Struyk | E21B 43/2408 166/250.06 |
| 2009/0308588 | A1 | 12/2009 | Howell et al. | |
| 2010/0038087 | A1 | 2/2010 | Skillingstad et al. | |
| 2012/0199353 | A1* | 8/2012 | Fermaniuk | E21B 34/14 166/305.1 |
| 2013/0186623 | A1* | 7/2013 | Waterhouse | E21B 43/12 166/272.3 |
| 2015/0122489 | A1* | 5/2015 | Wood | E21B 43/14 166/250.01 |

FOREIGN PATENT DOCUMENTS

WO 2015026340 A1 2/2015

OTHER PUBLICATIONS

International Search Report and Written Opinion for PCT/US2013/056014 dated May 13, 2014.

* cited by examiner

*Primary Examiner* — Yong-Suk (Philip) Ro
(74) *Attorney, Agent, or Firm* — McDermott Will & Emery LLP; Scott Richardson

(57) ABSTRACT

Disclosed are systems and methods of injecting steam into a wellbore. One disclosed injection tool includes a body defining an inner bore and a radial flow channel, one or more fluid conduits defined in the body at the radial flow channel, a shroud arranged about the body such that an annulus is defined and in fluid communication with the one or more fluid conduits and the surrounding wellbore environment, a sleeve arranged within inner bore and movable between a first position, where the sleeve occludes the one or more fluid conduits, and a second position, where the one or more fluid conduits are exposed, and first and second seals generated at opposing axial ends of the radial flow channel when the sleeve is in the first position.

20 Claims, 3 Drawing Sheets

WELLBORE STEAM INJECTOR

This application is a National Stage entry of and claims priority to International Application No. PCT/US2013/056014, filed on Aug. 21, 2013.

BACKGROUND

The present disclosure is generally related to wellbore operations and, more particularly, to systems and methods of injecting steam into a wellbore.

Recovery of valuable hydrocarbons in some subterranean formations can sometimes be difficult due to a relatively high viscosity of the hydrocarbons and/or the presence of viscous tar sands in the formations. In particular, when a production well is drilled into a subterranean formation to recover oil residing therein, often little or no oil flows into the production well even if a natural or artificially induced pressure differential exists between the formation and the well. To overcome this problem, various thermal recovery techniques have been used to decrease the viscosity of the oil and/or the tar sands, thereby making the recovery of the oil easier.

Steam assisted gravity drainage (SAGD) is one such thermal recovery technique and utilizes steam to thermally stimulate viscous hydrocarbon production by injecting steam into the subterranean formation to the hydrocarbons residing therein. As the steam is injected into the surrounding subterranean formation, it contacts cold oil within the formation. The steam gives up heat to the oil it comes into contact with and condenses, and the oil absorbs the heat and becomes mobile as its viscosity is reduced. Accordingly, as the temperature of the oil increases, it is able to more easily flow to a production well to be produced to the surface.

The temperature of the steam during SAGD operations is highly affected by the hydrostatic head of the production of the heated hydrocarbons. As a result, it is advantageous to control the production flow and the steam injection. Moreover, the temperature limit of typical sealing systems is a limiting factor in the use of sliding side door type of technology.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is generally related to wellbore operations and, more particularly, to systems and methods of injecting steam into a wellbore.

The embodiments described herein include an injection tool that is able to move between closed and open positions. In the closed position, a sleeve within the injection tool substantially occludes a plurality of fluid conduits that provide fluid communication between the surrounding wellbore environment and the interior of the injection tool. In the open position, the sleeve is moved such that the fluid conduits are exposed and therefore able to provide fluid communication. The flow of fluid through the fluid conduits may be adjusted or otherwise optimized by using one or more nozzles or nozzle plugs. The injection tool may also employ metal-to-metal seals to ensure the prevention of fluid flow when in the closed position. Advantageously, the metal-to-metal seals are able to withstand increased temperatures and, whereas elastomeric seals are often compromised by high temperature oils, metal-to-metal seals are relatively unaffected by the influx of such fluids.

Figure 1:
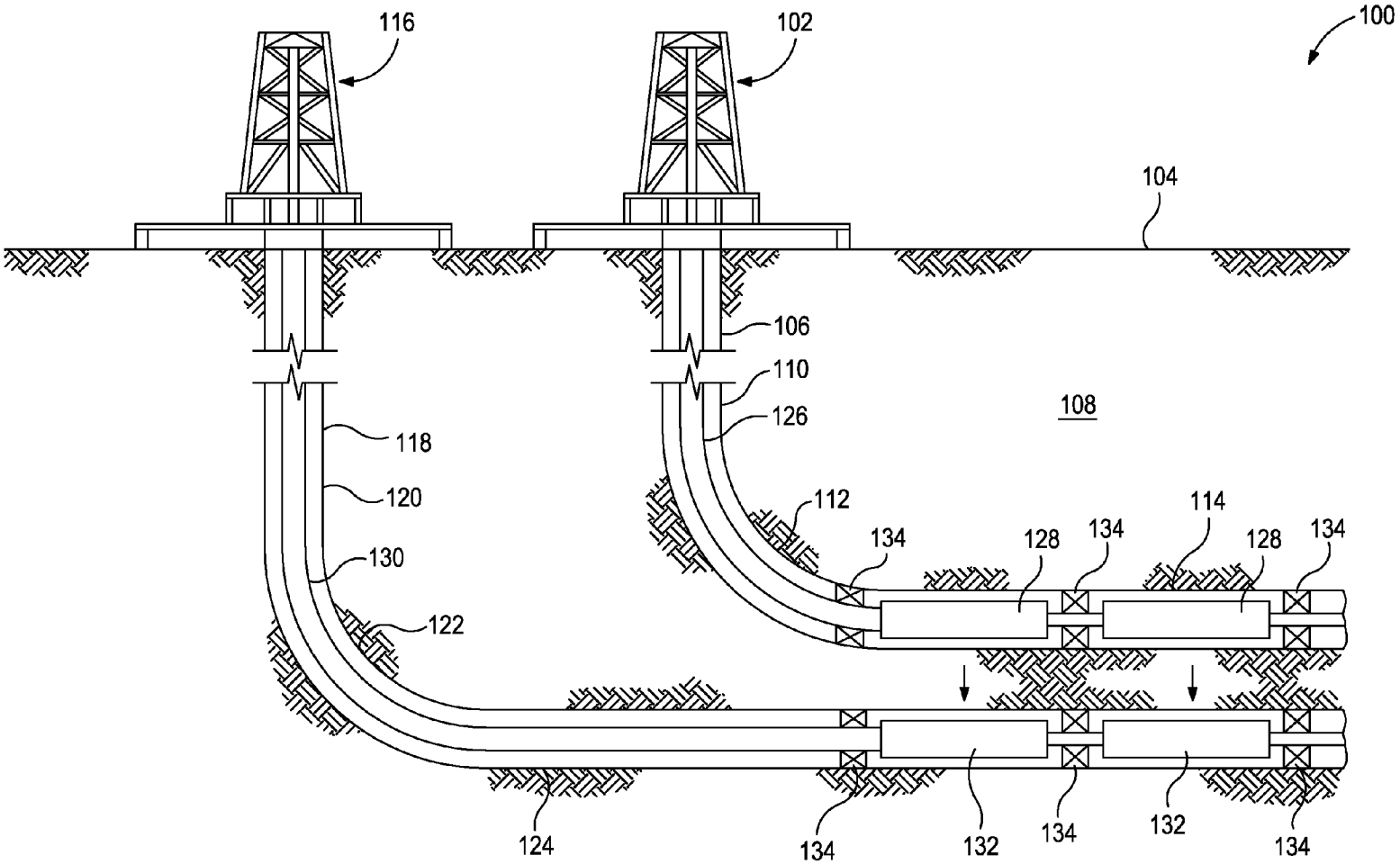
FIG. 1 illustrates a well system that may embody or otherwise employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may be configured for producing and/or recovering hydrocarbons using a steam assisted gravity drainage (SAGD) method. Those skilled in the art, however, will readily appreciate that the presently described and disclosed embodiments may equally be useful in other types of hydrocarbon recovery operations, without departing from the scope of the disclosure.

The depicted system 100 may include an injection service rig 102 that is positioned on the earth's surface 104 and extends over and around an injection wellbore 106 that penetrates a subterranean formation 108. The injection service rig 102 may encompass a drilling rig, a completion rig, a workover rig, or the like. The injection wellbore 106 may be drilled into the subterranean formation 108 using any suitable drilling technique and may extend in a substantially vertical direction away from the earth's surface 104 over a vertical injection wellbore portion 110. At some point in the injection wellbore 106, the vertical injection wellbore portion 110 may deviate from vertical relative to the earth's surface 104 over a deviated injection wellbore portion 112 and may further transition to a horizontal injection wellbore portion 114, as illustrated.

The system 100 may further include an extraction service rig 116 (e.g., a drilling rig, completion rig, workover rig, and the like) that may also be positioned on the earth's surface 104. The service rig 116 may extend over and around an extraction wellbore 118 that also penetrates the subterranean formation 108. Similar to the injection wellbore 106, the extraction wellbore 118 may be drilled into the subterranean formation 108 using any suitable drilling technique and may extend in a substantially vertical direction away from the earth's surface 104 over a vertical extraction wellbore portion 120. At some point in the extraction wellbore 118, the vertical extraction wellbore portion 120 may deviate from vertical relative to the earth's surface 104 over a deviated extraction wellbore portion 122, and transition to a horizontal extraction wellbore portion 124. As illustrated, at least a portion of horizontal extraction wellbore portion 124 may be vertically offset from and otherwise disposed below the horizontal injection wellbore portion 114.

While the injection and extraction service rigs 102, 116 are depicted in FIG. 1 as included in the system 100, in some embodiments, one or both of the service rigs 102, 116 may be omitted and otherwise replaced with a standard surface wellhead completion or installation that is associated with the system 100. Moreover, while the well system 100 is depicted as a land-based operation, it will be appreciated that the principles of the present disclosure could equally be applied in any sub-sea application where either service rig 102, 116 may be replaced with a floating platform or sub-surface wellhead installation, as generally known in the art.

The system 100 may further include an injection work string 126 (e.g., production string/tubing) that extends into the injection wellbore 106. The injection work string 126 may include a plurality of injection tools 128, each injection tool 128 being configured to regulate the outflow of a fluid (e.g., steam) to be injected into the surrounding subterranean formation 108. In some embodiments, however, one or more of the injection tools 128 may also be used to produce or draw in fluids from the surrounding formation 108 and into the injection work string 126, as described in greater detail below. Similarly, the system 100 may include an extraction work string 130 (e.g., production string/tubing) that extends into the extraction wellbore 118. The extraction work string 130 may include a plurality of production tools 132, each production tool being configured to draw fluids, such as hydrocarbons, into the extraction work string 130 from the surrounding subterranean formation 108.

One or more wellbore isolation devices 134 (e.g., packers, gravel pack, collapsed formation, or the like) may be used to isolate annular spaces of both the injection and extraction wellbores 106, 118. As illustrated, the wellbore isolation devices 134 may be configured to substantially isolate separate injection and production tools 128, 132 from each other within the corresponding injection and extraction wellbores 106, 118, respectively. As a result, fluids may be injected into the formation 108 at discrete and separate intervals via the injection tools 128 and fluids may subsequently be produced from multiple intervals or "pay zones" of the formation 108 via isolated production tools 132 arranged along the extraction work string 130.

While the system 100 is described above as comprising two separate wellbores 106, 118, other embodiments may be configured differently, without departing from the scope of the disclosure. For example, in some embodiments the work strings 126, 130 may both be located in a single wellbore. In other embodiments, vertical portions of the work strings 126, 130 may both be located in a common wellbore but may each extend into different deviated and/or horizontal wellbore portions from the common vertical portion. In yet other embodiments, the vertical portions of the work strings 126, 130 may be located in separate vertical wellbore portions but may both be located in a shared horizontal wellbore portion.

In exemplary operation of the well system 100, a fluid (e.g., steam) may be conveyed into the injection work string 126 and ejected therefrom via the injection tools 128 and into the surrounding formation 108. Introducing steam into the formation 108 may reduce the viscosity of hydrocarbons present in the formation and otherwise affected by the injected steam, thereby allowing gravity to draw the affected hydrocarbons downward and into the extraction wellbore 118. The extraction work string 130 may be caused to maintain an internal bore pressure (e.g., a pressure differential) that tends to draw the affected hydrocarbons into the extraction work string 130 through the production tools 132. The hydrocarbons may thereafter be pumped out or flowed out of the extraction wellbore 118 and into a hydrocarbon storage device and/or into a hydrocarbon delivery system (i.e., a pipeline).

While FIG. 1 depicts only two injection and production tools 128, 132, respectively, those skilled in the art will readily appreciate that more than two injection and production tools 128, 132 may be employed in each of the injection and extraction work strings 126, 130, without departing from the scope of the disclosure. In the embodiments described herein, the injection and production tools 128, 132 may be used in combination and/or separately to inject fluids into the wellbore and/or to recover fluids from the wellbore. In other embodiments, any combination of injection and production tools 128, 132 may be located within a shared wellbore and/or amongst a plurality of wellbores and the injection and production tools 128, 132 may be associated with different and/or shared isolated annular spaces of the wellbores, the annular spaces, in some embodiments, being at least partially defined by one or more zonal isolation devices 134. Furthermore, in some embodiments, the injection and production tools 128, 132 may be arranged in a single wellbore, or the injection and production tools 128, 132 may function for both injection and production applications.

Figure 2A:
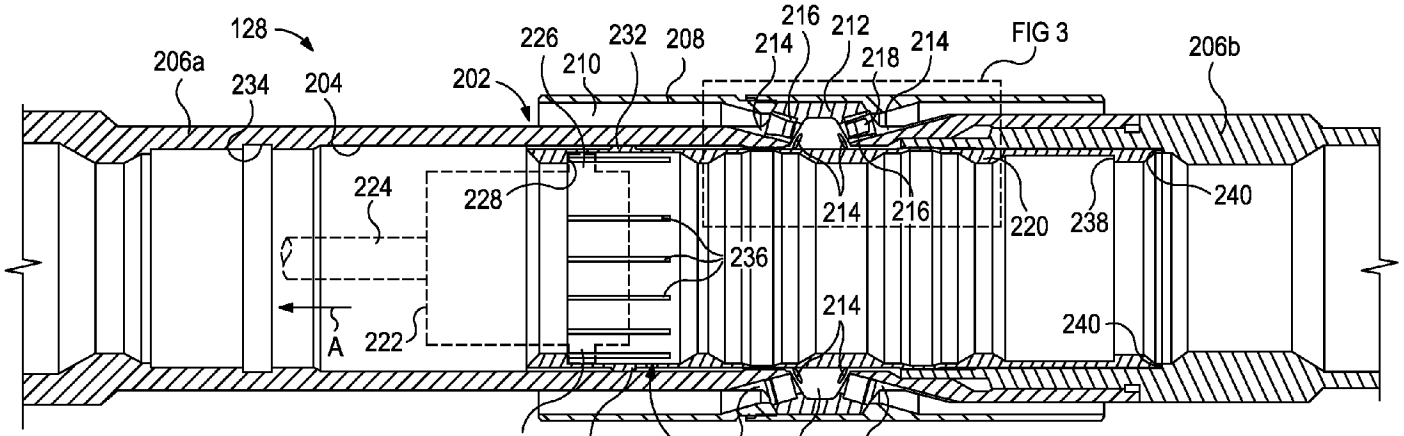
FIGS. 2A and 2B depict cross-sectional views of an injection tool in open and closed positions, respectively, according to one or more embodiments.
Figure 2B:
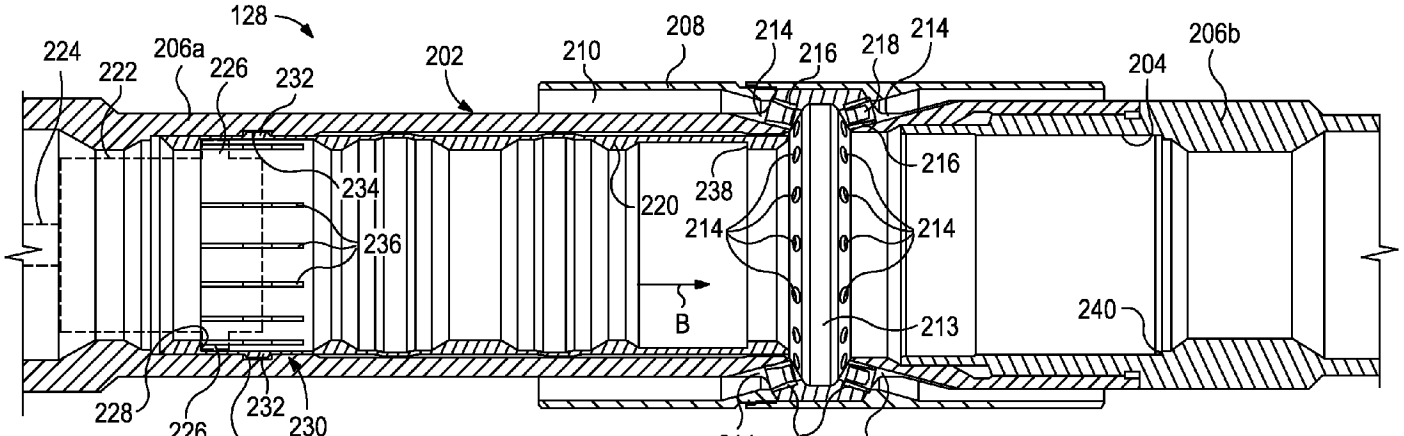

Referring now to FIGS. 2A and 2B, with continued reference to FIG. 1, illustrated are cross-sectional views of an injection tool 128, according to one or more embodiments. More particularly, FIG. 2A depicts the injection tool 128 in a closed position and FIG. 2B depicts the injection tool 128 in an open position. As illustrated, the injection tool 128 may include a body 202 that defines an inner flow path or inner bore 204. In some embodiments, the body 202 may include or otherwise encompass an upper sub 206*a* and a lower sub 206*b* operatively coupled together. The lower sub 206*b* may be coupled or otherwise attached to the upper sub 206*a* such that the body 202 forms a generally continuous conduit for fluids (e.g., steam) to pass therethrough. In some embodiments, the upper and lower subs 206*a,b* may be mechanically fastened to each other using bolts, screws, pins, or other types of mechanical fasteners. In other embodiments, the upper and lower subs 206*a,b* may be threadably attached to each other via corresponding threadings defined in each component. In yet other embodiments, the upper and lower subs 206*a,b* may be welded or brazed to each other, without departing from the scope of the disclosure.

A shroud 208 may be arranged about a portion of the body 202 and may be offset therefrom a short distance such that an annulus 210 is defined therebetween. As depicted, the shroud 208 may be coupled or otherwise attached to a radial upset 212 defined on the upper sub 206*a* and thereby define the annulus 210. In other embodiments, the radial upset 212 may otherwise form part of the lower sub 206*b* such that the shroud 208 may equally be coupled or otherwise attached to the lower sub 206*b*, without departing from the scope of the disclosure. In some embodiments, the shroud 208 may be mechanically fastened to the body 202 using one or more mechanical fasteners (e.g., bolts, screws, pins, etc.). In other embodiments, the shroud 208 may be threaded to the body 202 or attached to the body 202 by a heat shrink process. In yet other embodiments, as described in more detail below, the shroud 208 may be welded or brazed to the body 202.

The annulus 210 defined between the shroud 208 and the body 202 may fluidly communicate with a radial flow channel 213 and one or more fluid conduits 214 defined in the body 202 at the radial flow channel 213. The radial flow channel 213 may form part of the body 202 and otherwise be defined within the radial upset 212. Moreover, the radial flow channel 213 may fluidly communicate the fluid conduits 214 with the inner bore 204.

As illustrated, the radial flow channel 213 and the fluid conduits 214 are defined in the upper sub 206*a*, but may equally be formed in portions of the lower sub 206*b* in alternative embodiments. The fluid conduits 214 may provide fluid communication between the surrounding wellbore and the inner bore 204 when the injection tool 128 is in the open position (FIG. 2B). While a certain number of fluid conduits 214 is shown in FIGS. 2A and 2B, those skilled in the art will readily appreciate that more or fewer may be employed, without departing from the scope of the disclosure. Moreover, in embodiments where there are multiple fluid conduits 214, the fluid conduits 214 may be either equidistantly or randomly spaced about the circumference of the body 202.

In some embodiments, a nozzle 216 may be arranged in one or more of the fluid conduits 214. In FIG. 2A, the fluid conduits 214 shown at the top of the figure each have a nozzle 216 arranged therein, but the fluid conduits 214 shown at the bottom of the figure do not have a nozzle 216 arranged therein. The nozzles 216 may serve as fluid restrictors or flow regulators during both injection and production operations using the injection tool 128. The nozzle 216 may include, but is not limited to, a flow control device, an inflow control device (passive or active), an autonomous inflow control device, a valve, an expansion valve, a restriction, combinations thereof, or the like.

At a given flow rate, density, and viscosity of wellbore fluids, the pressure loss through the nozzle(s) 216 may be changed. In some embodiments, it may require several nozzles 216 to alter the fluid pressure within the surrounding formation 108 (FIG. 1). Moreover, the pressure within the inner bore 204 may not be altered unless the restriction value of several nozzles 216 is changed. In embodiments where the restriction value of a significant number of nozzles 216 is changed, the system dynamics may correspondingly change.

The nozzle 216 may be retained within its corresponding fluid conduit 214 by multiple means. For example, the nozzle 216 may be arranged within a corresponding fluid conduit 214 via a heat shrinking process, by threading the nozzle 216 into the fluid conduit 214, by welding the nozzle 216 in place, or by adhesively coupling the nozzle 216 to the fluid conduit 214 using industrial-strength adhesives. In other embodiments, the nozzle 216 may be arranged within its corresponding fluid conduit 214 and prevented from removal therefrom by the shroud 208. In such embodiments, the shroud 208 may be welded to the body 202 such that a portion of the shroud 208 biases the nozzle 216 and otherwise prevents the nozzle 216 from escaping the fluid conduit 214. In yet other embodiments, the nozzle 216 may be retained within its corresponding fluid conduit 214 using a combination of the foregoing methods.

In some embodiments, one or more of the nozzles 216 may include a nozzle plug 218 arranged therein or otherwise fixedly attached thereto (only one nozzle plug 218 shown in FIGS. 2A and 2B). The nozzle plug 218 may generally prevent fluid communication through the corresponding fluid conduit 214, and thereby serve to affect or alter the overall flow rate of fluids out of or into the inner bore 204. Accordingly, a well operator may be able to adjust the flow rate of fluids through the injection tool 128 by selectively or strategically adding or removing nozzle plugs 218. Placing additional nozzle plugs 218 will effectively reduce the flow rate of fluids out of or into the inner bore 204 while removing nozzle plugs 218 will effectively increase the flow rate of fluids out of or into the inner bore 204.

The injection tool 128 may further include a sleeve 220 movably arranged within the body 202 between a first or closed position (FIG. 2A) and a second or open position (FIG. 2B). In the first position, the sleeve 220 generally occludes the fluid conduits 214 such that fluid communication therethrough is substantially prevented. In the second position, however, the sleeve 220 has moved within the inner bore 204 such that the fluid conduits 214 are exposed and able to communicate fluids between the inner bore 204 and the surrounding wellbore environment. Accordingly, the sleeve 220 in the first position corresponds to the injection tool 128 in the closed position, and the sleeve 220 in the second position corresponds to the injection tool 128 in the open position.

In order to move the sleeve 220 from the first position to the second position, a shifting tool 222 (shown in phantom) may be conveyed downhole and introduced into the body 202 and the sleeve 220. The shifting tool 222 may be run in hole via a conveyance 224, such as wireline, slickline, coiled tubing, a downhole tractor device, or any other suitable conveyance able to advance the shifting tool 222 within the wellbore. In at least one embodiment, the shifting tool 222 may have one or more keys or lugs 226 configured to extend radially from the shifting tool 222 and locate or otherwise engage an upper shoulder 228 defined on the sleeve 220. In some embodiments, the lugs 226 may be spring loaded. In other embodiments, however, the lugs 226 may be actuatable (e.g., mechanically, electro-mechanically, pneumatically, hydraulically, etc.) to extend or retract with respect to the body of the shifting tool 222. While having been described herein as having a particular configuration, those skilled in the art will readily recognize that many variations of the shifting tool 222 may be used to engage and shift the sleeve 220, without departing from the scope of the disclosure.

Once properly engaged with the upper shoulder 228 of the sleeve 220, the shifting tool 222 may then be moved in a first direction A (FIG. 2A) by applying a force on the conveyance 224. Moving the shifting tool 222 in the first direction A may correspondingly force the sleeve 220 to move in the same direction within the inner bore 204, thereby shifting the sleeve 220 from first position to the second position.

At or near its uphole end, the sleeve 220 may provide or otherwise define a collet assembly 230 configured to lock or otherwise secure the sleeve 220 in the second position. In some embodiments, the collet assembly 230 may define one or more locking keys 232 that extend radially from the collet assembly 230. The locking keys 232 may be configured to locate and extend into an annular groove 234 defined on the inner radial surface of the body 202 (i.e., the upper sub 206*a*), thereby securing the sleeve 220 against axial movement in the second position (FIG. 2B).

The collet assembly 230 may define one or more longitudinal slots 236 therein. The longitudinal slots 236 may be configured to allow portions of the collet assembly 230 to flex such that the locking keys 232 are able to move or bend in and out of the groove 234 in response to an appropriate amount of axial force applied to the sleeve 220. As shown in FIG. 2B, the shifting tool 222 has engaged and moved the sleeve 220 to the second position, thereby exposing the fluid conduits 214 and allowing fluid communication between the inner bore 204 and the surrounding wellbore environment.

In order to move the sleeve 220 back to the first position, and thereby occlude the fluid conduits 214 such that fluid communication therethrough is generally prevented, the shifting tool 222 may be advanced within the body 202 until engaging a lower shoulder 238 defined on the sleeve 220. More particularly, the lugs 226 may be actuated to engage the lower shoulder 238 and a force may be applied on the shifting tool 222 via the conveyance 224 in a second direction B (FIG. 2B), where the second direction B is opposite the first direction A. The force is then transferred to the sleeve 220 in an amount sufficient to force the locking keys 232 inwards and out of engagement with the groove 234. Once out of engagement with the groove 234, the sleeve 220 may be able to move axially in the second direction B and to the first position (FIG. 2A). In at least one embodiment, the sleeve 220 may be advanced in the second direction B until engaging a shoulder 240 defined on the inner radial surface of the body 202 (i.e., the lower sub 206*b*).

While a particular design and configuration of the shifting tool 222 has been described herein, it will be appreciated that different types and configurations of shifting tools may be used to move the sleeve 220 in the directions A and B in order to place the sleeve 220 in the second and first positions, respectively. For instance, in at least one embodiment, the lugs 226 of the shifting tool 222 may be replaced with a selective profile configured to interact with a corresponding profile defined at one or both ends of the sleeve 220. In such embodiments, one or both of the upper and lower shoulders 228, 238 may be replaced with a profile configured to mate with the selective profile of the lugs 226, and thereby allowing the shifting tool 222 to suitably engage and move the sleeve 220 in either direction A and/or B. Moreover, those skilled in the art will readily appreciate that the injection tool 128 may be designed differently such that other designs and/or configurations of shifting tools may equally be used, without departing from the scope of the disclosure.

Figure 3:
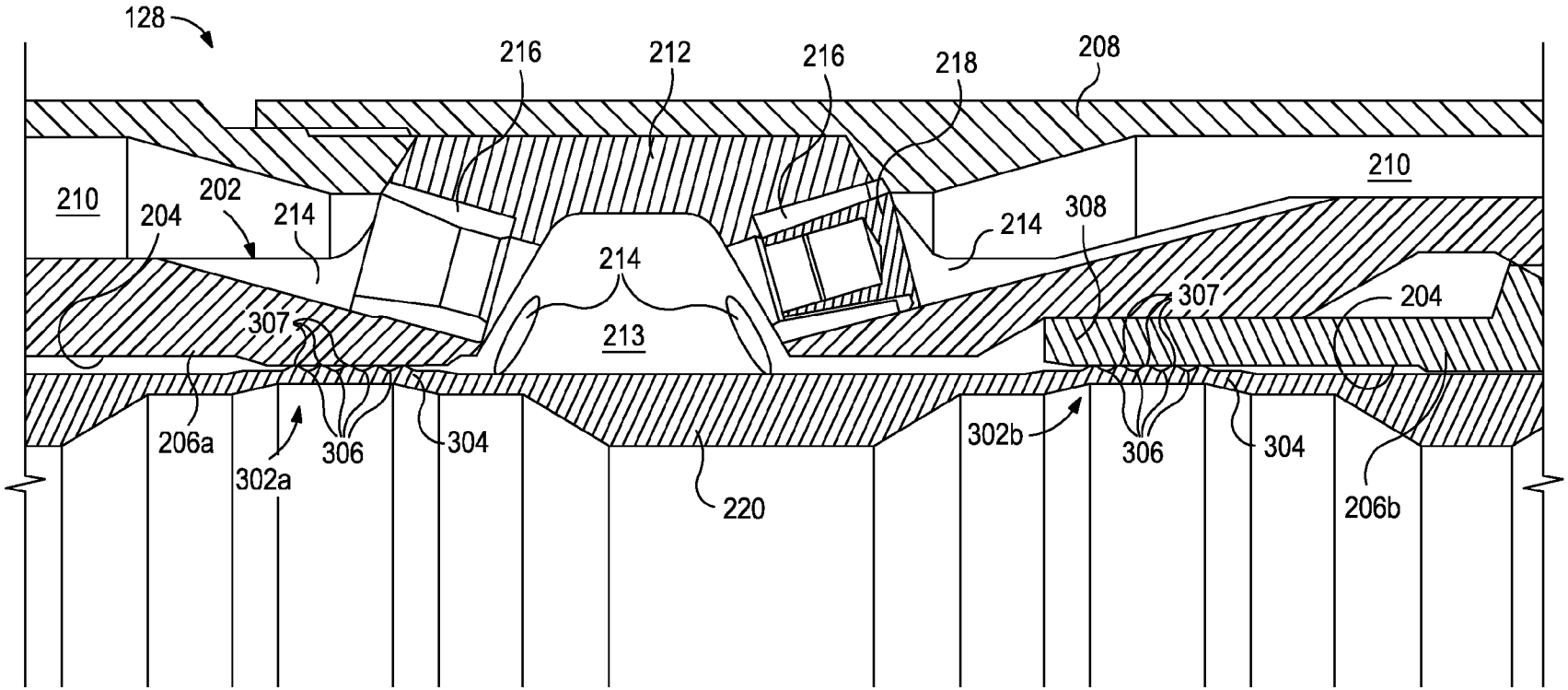
FIG. 3 illustrates an enlarged view of a portion of the injection tool of FIGS. 2A and 2B, according to one or more embodiments

Referring now to FIG. 3, illustrated is an enlarged view of a portion of the injection tool 128, according to one or more embodiments. More particularly, FIG. 3 shows an enlarged view of the area indicated by the dashed (phantom) box in FIG. 2A. As illustrated, the sleeve 220 is in the first position in FIG. 3 and, therefore, the injection tool 128 is in its closed position where the sleeve 220 generally occludes the fluid conduits 214 such that fluid communication therethrough is substantially prevented.

In the first position, the sleeve 220 may also provide a seal against the inner radial surface of the body 202 (i.e., against the inner radial surfaces of the upper and lower subs 206*a,b*) on opposing axial sides or ends of the radial flow channel 213 within the inner bore 204. More particularly, the sleeve 220 may provide at least a first seal 302*a*, generated axially uphole from the radial flow channel 213, and a second seal 302*b*, generated axially downhole from the radial flow channel 213. The first and second seals 302*a,b* may cooperatively prevent fluid communication between the inner bore 204 and the surrounding wellbore environment via the radial flow channel 213, the fluid conduits 214, and the annulus 210.

The first and second seals 302*a,b* may each define or otherwise provide a radial protrusion 304 configured to engage a corresponding portion of the inner radial surface of the body 202 on opposing axial sides of the radial flow channel 213. In the illustrated embodiment, the radial protrusion 304 of the first seal 302*a* may be configured to engage the inner radial surface of the upper sub 206*a*, and the radial protrusion 304 of the second seal 302*b* may be configured to engage the inner radial surface of the lower sub 206*b*. Each of the first and second seals 302*a,b* may provide a metal-to-metal seal against the body 202 in order to seal the interface at each corresponding location.

A metal-to-metal seal may prove advantageous over elastomeric seals, which may fail in the presence of oils at elevated temperatures ranging between about 400° F. and about 600° F. For instance, while a typical ethylene propylene diene monomer (EPDM) O-ring seal may provide a reasonable seal against steam, such EPDM seals may degrade and fail in the presence of oils, especially at elevated temperatures such as those seen in SAGD operations. Following the injection of steam into a surrounding wellbore environment, injection tools are oftentimes "shut in" or closed for a predetermined period of time. During this time, the heated oils from the surrounding wellbore environment may enter the annulus 210, bypass the nozzles 216 (if any), and leach into the inner bore 204 of the body 202 via the fluid conduits 214. If the first and second seals 302*a,b* employed elastomeric seals, the sealing interface could potentially be compromised by the influx of oils at elevated temperatures.

In the depicted embodiment, however, the first and second seals 302*a,b* provide a metal-to-metal seal where the radial protrusions 304 each engage or otherwise contact the inner radial surface of the body 202 to form a fluid seal at the corresponding location. In some embodiments, one or more grooves 306 may be defined in one or both of the radial protrusions 304, thereby concurrently defining a corresponding number of bumps 307 on the radial protrusions 304. The grooves 306 may reduce the surface area of the corresponding seal 302*a,b*, thereby increasing the contact stress at that location between the seal 302*a,b* and the inner radial surface of the body 202. While the same radial loading may be applied, the reduced surface area may allow the bumps 307 remaining between adjacent grooves 306 to undergo plastic deformation against the inner radial surface of the body 202 and thereby generate a more uniform sealing interface.

The axial length of the radial protrusions 304 exposed to the sealing differential pressure defines an effective radial piston area that loads the sleeve 220. As will be appreciated, the axial length may be modified in order to increase or decrease the seal surface loading. Accordingly, there are several variables that may affect the force required to move the sleeve 220 out of engagement with the inner radial surface of the body 202 including, but not limited to, material, inner diameter, wall thickness, effective pressure length, pressure direction, sealing contact area, friction reducing coatings or heat treated surfaces, temperature, mating surface initial interference, combinations thereof, and the like.

Moreover, the grooves 306 further generate a labyrinth-type sealing effect at the sealing interface of each seal 302*a,b*. As a result, any fluids attempting to escape into the inner bore 204 via the seals 302*a,b* are required to pass through a tortuous flow path defined by the grooves 306 and the bumps 307. Accordingly, the sealing capability of each seal 302*a,b* becomes more robust with the addition of the grooves 306 and the metal-to metal seal allows the seals 302*a,b* to operate in an increased temperature range (e.g., between about 400° F. and about 600° F.). As will be appreciated, temperature limitations may be limited by material choices as particular materials may affect strength reduction and the tendency to damage the highly loaded contact sealing surfaces at each seal 302*a,b*. For instance, the 400° F. to 600° F. temperature range mentioned above may be typical for relatively shallow steam injection wells, but those skilled in the art will readily recognize that the embodiments disclosed herein are not limited to such temperature ranges.

In some embodiments, the design of the first and/or second seals 302*a,b* may be modified in order to control the contact pressure of the sealing interface between the radial protrusions 304 and the inner bore 204 of the body 202 (i.e., the upper and lower subs 206*a,b*). Such design modifications may also control the production or injection differential pressure rating for the sleeve 220 and control the force required to shift the sleeve 220 from the first position (FIGS. 2A and 3) to the second position (FIG. 2B).

In one or more embodiments, for example, the thickness of the components that make up the first and second seals 302*a,b*, and the effective pressure area on such components may be altered or otherwise optimized for more efficient operation. The second seal 302*b*, for instance, includes a stem 308 that axially extends from the body 202 (i.e., the lower sub 206*b*) to engage the radial protrusion 304. The stem 308 is generally thinner than the remaining portions of the body 202 and may therefore be able to flex and elastically deform upon engaging the radial protrusion 304 of the second seal 302*b*. The radial interference between the stem 308 and the radial protrusion 304 can be controlled by accurately machining or intentionally causing the weaker surface to undergo plastic deformation on initial manufacturing or at assembly.

Accordingly, by adjusting the thickness of the stem 308, the pre-load forces exhibited between the stem 308 and the radial protrusion 304 may correspondingly increase or decrease the sealing engagement. By modifying the thickness of the stem 308, it is possible to modify the interference generated between the stem 308 and the radial protrusion 304 and thereby control the pressure that the sleeve 220 can hold at that location. Similarly, modifying the thickness of the stem 308 also adjusts the force required to move the sleeve 220 from the first position or otherwise the force required to move the protrusions 304 out of engagement with the inner radial surface of the body 202.

As will be appreciated, similar modifications to the first seal 302*a* may equally be made, without departing from the scope of the disclosure. In other embodiments, however, it may be that only one of the first or second seals 302*a,b* may be modified as described above.

As mentioned above, the injection tool 128 may be used for both injection and production operations. When in the open position (FIG. 2B) for injection operations, fluids (e.g., steam) may be ejected out of the inner bore 204 via the fluid conduits 214 and into the surrounding wellbore environment. The shroud 208 may prove useful in protecting adjacent casing (if any) or the inner wall of the wellbore from being directly blasted with the fluid via the nozzles 216. Instead, injected fluids are directed through the annulus 210 and exit the shroud 208 to flow upward or downward within the wellbore environment.

Embodiments disclosed herein include:

A. An injection tool may include a body defining an inner bore and a radial flow channel, one or more fluid conduits defined in the body at the radial flow channel and providing fluid communication between the inner bore and a surrounding wellbore environment, a shroud arranged about the body such that an annulus is defined between the shroud and the body, the annulus being in fluid communication with the one or more fluid conduits and the surrounding wellbore environment, a sleeve arranged within inner bore and movable between a first position, where the sleeve occludes the radial flow channel and the one or more fluid conduits, and a second position, where the radial flow channel and the one or more fluid conduits are exposed, and first and second seals generated at opposing axial ends of the radial flow channel when the sleeve is in the first position, each seal comprising a radial protrusion defined on the sleeve and configured to make a metal-to-metal seal against an inner radial surface of the body in order to prevent fluid communication between the inner bore and the surrounding wellbore environment.

B. A method may include introducing an injection tool into a wellbore, the injection tool including a body defining an inner bore, a radial flow channel, and one or more fluid conduits defined at the radial flow channel, the one or more fluid conduits providing fluid communication between the inner bore and a surrounding wellbore environment, placing a sleeve arranged within the injection tool in a first position where the radial flow channel and the one or more fluid conduits are occluded by the sleeve, sealing opposing axial ends of the radial flow channel with first and second seals generated when the sleeve is in the first position, each seal comprising a radial protrusion defined on the sleeve and configured to make a metal-to-metal seal against an inner radial surface of the body, and moving the sleeve to a second position where the radial flow channel and the one or more fluid conduits are exposed.

Each of embodiments A and B may have one or more of the following additional elements in any combination: Element 1: wherein the body comprises an upper sub coupled to a lower sub. Element 2: wherein the one or more fluid conduits are defined in the upper sub of the body. Element 3: wherein the shroud is coupled to a radial upset defined on the body. Element 4: further comprising a nozzle arranged in at least one of the one or more fluid conduits. Element 5: wherein the nozzle is at least one of a flow control device, an inflow control device, an autonomous inflow control device, a valve, an expansion valve, and a restriction. Element 6: wherein the shroud is coupled to the body such that a portion of the shroud biases the nozzle and prevents the nozzle from escaping the at least one of the one or more fluid conduits. Element 7: further comprising a plurality of nozzles arranged in at least some of the one or more fluid conduits, and a nozzle plug arranged in at least one of the plurality of nozzles. Element 8: further comprising a plurality of grooves defined in at least one of the radial protrusions, and one or more bumps defined on the at least one of the radial protrusions between adjacent grooves of the plurality of grooves, wherein the grooves increase contact stresses between the at least one of the radial protrusions and the inner radial surface of the body. Element 9: wherein the plurality of grooves and the one or more bumps generate a labyrinth-type seal against the inner surface of the body.

Element 10: further comprising injecting steam into the surrounding wellbore environment via the one or more fluid conduits when the sleeve is in the second position, and directing the steam in at least one of an upward and a downward direction within the wellbore with a shroud arranged about the body such that an annulus is defined between the shroud and the body, the annulus being in fluid communication with the one or more fluid conduits and the surrounding wellbore environment. Element 11: further comprising producing fluids into the inner bore from the surrounding wellbore environment via the one or more fluid conduits when the sleeve is in the second position. Element 12: further comprising adjusting a flow rate of the steam into the surrounding wellbore environment by arranging one or more nozzles in at least some of the one or more fluid conduits. Element 13: further comprising coupling the shroud to the body such that a portion of the shroud biases the one or more nozzles and thereby maintaining the one or more nozzles within the at least one of the one or more fluid conduits. Element 14: further comprising arranging one or more nozzle plugs in at least some of the one or more nozzles to further adjust the flow rate of the steam. Element 15: wherein sealing the opposing axial ends of the radial flow channel with the first and second seals further comprises increasing a contact stress at one of the first and second seals with a plurality of grooves defined in at least one of the radial protrusions and one or more bumps defined on the at least one of the radial protrusions between adjacent grooves of the plurality of grooves. Element 16: further comprising generating a labyrinth-type seal against the inner surface of the body with the plurality of grooves and the one or more bumps. Element 17: further comprising plastically deforming the one or more bumps against the inner radial surface of the body and thereby generating a more uniform sealing interface. Element 18: further comprising adjusting a contact pressure of at least one of the first and second seals by modifying a thickness of the body. Element 19: wherein moving the sleeve to the second position comprises introducing a shifting tool into the injection tool, engaging one or more lugs of the shifting tool on a first shoulder defined on the sleeve, and applying an axial force in a first direction on the sleeve via the shifting tool. Element 20: further comprising engaging the one or more lugs on a second shoulder defined on the sleeve, and applying an axial force in a second direction opposite the first direction on the sleeve via the shifting tool, and thereby moving the sleeve back to the first position.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. An injection tool, comprising:

a body defining an inner bore and a radial flow channel;

one or more fluid conduits defined in the body at the radial flow channel and providing fluid communication between the inner bore and a surrounding wellbore environment;

a shroud arranged about the body such that an annulus is defined between the shroud and the body, the annulus being in fluid communication with the one or more fluid conduits and the surrounding wellbore environment;

a sleeve arranged within inner bore and movable between a first position, where the sleeve occludes the radial flow channel and the one or more fluid conduits, and a second position, where the radial flow channel and the one or more fluid conduits are exposed; and in the sleeve first position, first and second seals are generated at opposing axial ends of the radial flow channel, each seal comprising a radial protrusion defined on the sleeve and configured to make a metal-to-metal seal against an inner radial surface of the body in order to prevent fluid communication between the inner bore and the surrounding wellbore environment.

2. The injection tool of claim 1, wherein the body comprises an upper sub coupled to a lower sub.

3. The injection tool of claim 2, wherein the one or more fluid conduits are defined in the upper sub of the body.

4. The injection tool of claim 1, wherein the shroud is coupled to a radial upset defined on the body.

5. The injection tool of claim 1, further comprising a nozzle arranged in at least one of the one or more fluid conduits.

6. The injection tool of claim 5, wherein the nozzle is at least one of a flow control device, an inflow control device, an autonomous inflow control device, a valve, an expansion valve, and a restriction.

7. The injection tool of claim 5, wherein the shroud is coupled to the body such that a portion of the shroud biases the nozzle and prevents the nozzle from escaping the at least one of the one or more fluid conduits.

8. The injection tool of claim 1, further comprising:

a plurality of nozzles arranged in at least some of the one or more fluid conduits; and a nozzle plug arranged in at least one of the plurality of nozzles.

9. The injection tool of claim 1, further comprising:

a plurality of grooves defined in at least one of the radial protrusions; and one or more bumps defined on the at least one of the radial protrusions between adjacent grooves of the plurality of grooves, wherein the grooves increase contact stresses between the at least one of the radial protrusions and the inner radial surface of the body.

10. The injection tool of claim 9, wherein the plurality of grooves and the one or more bumps generate a labyrinth-type seal against the inner surface of the body.

11. A method, comprising:

introducing an injection tool into a wellbore, the injection tool including a body defining an inner bore, a radial flow channel, and one or more fluid conduits defined at the radial flow channel, the one or more fluid conduits providing fluid communication between the inner bore and a surrounding wellbore environment;

placing a sleeve arranged within the injection tool in a first position where the radial flow channel and the one or more fluid conduits are occluded by the sleeve;

in a sleeve first position, sealing opposing axial ends of the radial flow channel with first and second seals are generated, each seal comprising a radial protrusion defined on the sleeve and configured to make a metal-to-metal seal against an inner radial surface of the body; and moving the sleeve to a second position where the radial flow channel and the one or more fluid conduits are exposed.

12. The method of claim 11, further comprising:

injecting steam into the surrounding wellbore environment via the one or more fluid conduits when the sleeve is in the second position; and directing the steam in at least one of an upward and a downward direction within the wellbore with a shroud arranged about the body such that an annulus is defined between the shroud and the body, the annulus being in fluid communication with the one or more fluid conduits and the surrounding wellbore environment.

13. The method of claim 11, further comprising adjusting a flow rate of the steam into the surrounding wellbore environment by arranging one or more nozzles in at least some of the one or more fluid conduits.

14. The method of claim 13, further comprising coupling the shroud to the body such that a portion of the shroud biases the one or more nozzles and thereby maintaining the one or more nozzles within the at least one of the one or more fluid conduits.

15. The method of claim 11, wherein sealing the opposing axial ends of the radial flow channel with the first and second seals further comprises increasing a contact stress at one of the first and second seals with a plurality of grooves defined in at least one of the radial protrusions and one or more bumps defined on the at least one of the radial protrusions between adjacent grooves of the plurality of grooves.

16. The method of claim 15, further comprising generating a labyrinth-type seal against the inner surface of the body with the plurality of grooves and the one or more bumps.

17. The method of claim 15, further comprising plastically deforming the one or more bumps against the inner radial surface of the body and thereby generating a more uniform sealing interface.

18. The method of claim 11, further comprising adjusting a contact pressure of at least one of the first and second seals by modifying a thickness of the body.

19. The method of claim 11, wherein moving the sleeve to the second position comprises:

introducing a shifting tool into the injection tool;

engaging one or more lugs of the shifting tool on a first shoulder defined on the sleeve; and applying an axial force in a first direction on the sleeve via the shifting tool.

20. The method of claim 19, further comprising:

engaging the one or more lugs on a second shoulder defined on the sleeve; and applying an axial force in a second direction opposite the first direction on the sleeve via the shifting tool, and thereby moving the sleeve back to the first position.

* * * * *